106-84 AU 118 EX
9/4/84 XR 4,469,517

106/84

United States Patent [19]

Cooke, Jr.

[11] Patent Number: 4,469,517

[45] Date of Patent: Sep. 4, 1984

[54] SILICATE TREATMENT OF IMPURE SILICA SANDS

[75] Inventor: Richard C. Cooke, Jr., North Riverside, Ill.

[73] Assignee: Acme Resin Corporation, Forest Park, Ill.

[21] Appl. No.: 459,421

[22] Filed: Jan. 20, 1983

Related U.S. Application Data

[63] Continuation of Ser. No. 305,743, Sep. 25, 1981, abandoned.

[51] Int. Cl.[3] ..... B28B 7/34

[52] U.S. Cl. ..... 106/38.3; 106/38.35; 106/38.7; 106/84; 164/527; 427/214; 427/215; 427/221; 428/404; 428/407; 523/142; 523/145

[58] Field of Search ..... 164/16, 21, 526, 527; 106/38.7, 38.35, 38.3, 38.9, 84; 523/142, 145; 428/404, 407; 427/214, 215, 221

[56] References Cited

U.S. PATENT DOCUMENTS

| | | | |
|---|---|---|---|
| 2,128,404 | 8/1938 | Dunbeck | 106/38.3 |
| 2,818,620 | 1/1958 | Moore | 164/526 |
| 2,947,641 | 8/1960 | Bleuenstein | 106/38.3 |
| 3,074,802 | 1/1963 | Alexander et al. | 106/38.3 |
| 3,409,579 | 11/1968 | Robins | 260/38 |
| 4,154,894 | 5/1979 | Bushey | 428/404 |

OTHER PUBLICATIONS

Kirk-Othmer, Ency. of Chemical Tech., Third ed., vol. 6, pp. 208-209.

*Primary Examiner*—Lorenzo B. Hayes
*Attorney, Agent, or Firm*—Stanley M. Parmerter

[57] ABSTRACT

A process is provided for treating impure silica-containing sands to make them more suitable for foundry use. The sands are treated with aqueous alkali metal silicate solutions and the resulting mixture is heated before the sands are coated with a resin binder. Foundry cores and molds prepared with these treated sands show improved hot and cold tensile strengths.

23 Claims, No Drawings

SILICATE TREATMENT OF IMPURE SILICA SANDS

This is a continuation, of copending application Ser. No. 305,743, filed Sept. 25, 1981, now abandoned.

FIELD OF THE INVENTION

This invention relates to silica-containing foundry sand and to a process for treating silica-containing foundry sand with an alkali metal silicate to improve the tensile, strength of foundary cores or molds made from the sand.

BACKGROUND OF THE INVENTION

In the foundry art, cores or molds for making metal castings are normally prepared from a mixture of an aggregate material, such as sand, and a binding amount of a binder or binder system. Typically, after the aggregate material and binder have been mixed, the resulting mixture is rammed, blown or otherwise formed to the desired shape or pattern and then cured with the use of catalysts and/or heat to a solid, cured state.

A variety of different processes for forming molds and cores have been developed in the foundry industry. One type of process known as the shell molding process, is well known in the art. While there are many variations of this process, the process essentially comprises depositing a combination of sand and potentially thermosetting resin against a heated pattern such that the resin melts and cures to form a rigid shell mold or core section for use in the casting of metals. The combination of resin and sand used in the process can be a mixture of powdered resin and sand, or a free-flowing coated sand in which each grain is coated with a non-tacky layer of resin.

The production of a core or mold by the shell process involves two basic steps, the invest and the cure step. In the first step, the resin-coated sand is dumped onto or blown against the heated metal pattern. The resin-coated sand is held against the pattern (invested) until the shell is thick enough to hold metal in a given application. In the second step, the resin-coated sand is dumped or dropped away from the shell of bonded coated particles of sand and the resulting shell is cured. After the shell is cured, it is removed from the hot metal pattern and is ready for use.

Another process, known to the art as the "no-bake" process, is also used in forming resin cores. This process requires no external heating. Instead, curing is accomplished by means of a catalyst added just before the sand and resin components are introduced into the core box. Base-cured resin components used in the no-bake process are generally mixtures of polyols and polyisocyanates. Solutions of these components are usually coated on the sand immediately before use.

A third process for making cores and molds employs sands treated with core oil mixes. These mixes contain drying oils and cereal binders. Cores and molds made with such core oil mixes are cured by baking them in an oven.

In all of these processes, the binder which has been mixed with sand acts, when cured, to bind the particles of sand in the form of the pattern. The core or mold must be strong enough to contain the molten metal until it solidifies. For this reason, a core or mold with high tensile strength is required.

One factor influencing the tensile strength of the cores and molds is the quality of the sand used in their preparation. When a silica sand is employed, it is generally necessary to use a sand or high purity. In the past, when silica sands of lower purity were used, it was necessary to add large amounts of binder to ensure structural integrity of the mold. This was not only costly but led to other undesirable results when gaseous decomposition products of the excess resin penetrated into the molten or solidifying metal resulting in pinholes and scarring of the metal shape.

Impure silica sands, such as lake and bank sands, are readily available in many areas of the United States. These impure sands are sometimes beneficiated by various processes such as water washing. However, it is still necessary to use excess binder with the washed sands to obtain the desired tensile strength of the cores and molds made from them. It is therefore desirable to develop a process whereby these inexpensive sands can be used to make foundary cores and molds without the need to use excess binder with the sand.

Bushey described a method for treating zircon-containing sands, U.S. Pat. No. 4,115,345, and olivine sands, U.S. Pat. No. 4,154,894, with an alkali metal silicate to improve the tensile strengths of resin shell molds or cores made from the sands. However, he reported that when this method was used with silica and chromite sands, no improvement in the tensile strength of the cores and molds was observed.

A process has now been discovered which permits the use of impure silica sands in conjunction with moderate amounts of binder to form foundry cores and molds with improved tensile strength. This process is less expensive than present beneficiation methods and gives cores and molds with improved tensile strengths.

A further unexpected benefit of using these treated sands is that cores prepared from them by the base-curing "no-bake" process are more readily released from the core box. Easy release of the cores is commercially important, since sticking cores slow down the core-making process and often become broken and useless.

SUMMARY OF THE INVENTION

In accordance with this invention, there is provided a process for the preparation of treated silica sand which is useful for forming foundry cores and molds having improved tensile strength. The process comprises treating an impure silica sand with an aqueous solution of an alkali metal silicate and heating the mixture of sand and silicate.

Additionally, in accordance with this invention, there is provided a process for the preparation of a molding composition useful for forming foundry cores and molds having improved tensile strength. The process comprises treating impure silica sand with an aqueous solution of an alkali metal silicate and heating the mixture of sand and silicate. The treated sand is then mixed or coated with an effective bonding amount of a binder selected from the group consisting of shell resins, base-curing "no-bake" resin compounds and core oil mixes.

Furthermore, in accordance with this invention, there is provided silica foundry sand useful for making foundry cores and molds with improved tensile strength. This is prepared by treating impure silica sand with an aqueous solution of an alkali metal silicate and heating the mixture of sand and silicate.

Finally, in accordance with this invention, there is provided a molding composition useful for preparing foundry cores and molds having improved tensile strength. This composition comprises an impure silica sand, which has been treated by heating with an aqueous solution of an alkali metal silicate, and an effective bonding amount of a binder. The binder is selected from the group consisting of shell resins, base-curing "no-bake" resin components and core oil mixes.

DETAILED DESCRIPTION OF THE INVENTION

Any impure silica sands may be used in the practice of this invention. Examples of such sands are lake and bank sands which generally consist of from about 85% to about 98% by weight of silicon dioxide and small amounts of such impurities as aluminum oxide, iron oxide, alkaline oxides and alkaline earth oxides. The impure silica sand can be a naturally-occurring silica sand or a mixture of various silica sands. The processes of this invention are useful if the sand or mixture of sands contain less than about 99% silicon dioxide.

Commercially available lake and bank silica sands include 20KK Sand, available from the Martin Marietta Corporation, Bridgman, Mich.; Ludington Sand, available from the Sargent Sand Company, Saginaw, Mich.; Muskegon Sand No. 850 and Beneficiated Muskegon Sand W/51, available from the Nugent Sand Company, Muskegon, Mich.; and Vassar Sand, available from the Sargent Sand Company, Saginaw, Mich.

In the process of this invention, the impure silica sand is treated with an aqueous solution of an alkali metal silicate. Treatment may be carried out by stirring a slurry of the sand in a dilute silicate solution. It is often satisfactory to treat the sand with a more concentrated silicate solution by placing the sand in a mixer and adding the required amount of silicate solution to the sand with mixing. Alternatively, the silicate solution may be sprayed onto a thin layer of the sand.

Any alkali metal silicate, such as sodium and potassium silicate, can be employed in the process of this invention. Solutions of sodium silicate are commercially available. Such solutions contain varying ratios of sodium oxide to silicon dioxide. These weight ratios may vary from 1 to 4 parts of silicon dioxide per 1 part of sodium oxide. The amount of water present in the alkali metal silicate solution is not critical. However, sufficient water should be present to permit adequate dispersion of the silicate over the surface of the sand grains.

The amount of alkali metal silicate used with a given and should be an amount that effectively imparts the desired strength to the cores or molds without interfering with the free-flowing properties of the silicate-treated sand. It is preferred to use from about 0.2 to about 1.1 g of silicate on a dry solids basis per kg of sand.

After the silica sand has been thoroughly mixed with the silicate solution, the sand may be isolated from the slurry by any conventional means such as decantation or filtration. However, when the more concentrated solutions of silicate are employed, no mechanical separation of the sand from the silicate solution is required. It is only necessary to heat the sand to about 100° C., or above, for a short period of time to evaporate a portion of the water and provide a free-flowing sand for use in the coating process. This simplifies the process by avoiding a decantation or filtration step.

Alternatively, the sand can be preheated before the silicate solution is added to it. Mixing is then continued until the water is evaporated.

The silicate-treated silica sands of this invention are used to make foundry molds or cores using the procedures practiced with pure silica sand. In general, these processes involve mixing the sand with effective bonding amounts of binders. Usually, the components of the binders are coated on the sand to insure their uniform distribution.

Details of the preparation and use of resin-coated sands in the shell molding process are given in U.S. Pat. No. 3,838,095, the entire disclosure of which is incorporated herein by reference. Illustrative of "no-bake" processes, using base-curing polyurethane resin components, are U.S. Pat. Nos. 3,409,579 and 3,429,848, which are also incorporated herein by reference. The use of core oil mixes as foundry core binders is described in U.S. Pat. No. 2,875,073 which is likewise incorporated herein by reference.

Suitable resins for use in the shell-molding process include phenol-formaldehyde novolak resins which become thermosetting when heated in the presence of a curing agent. Hexamethylenetetramine is a satisfactory curing agent for these resins. Single-stage phenol-formaldehyde shell resins which require no added curing agent can also be used. Foundry sand, which has been coated or mixed with resin is placed in a mold and heated to cause the resin to harden forming a shell of resin-bonded sand. When the silicate-treated silica sand of this invention is used as the sand component in the mold, the resulting mold shows considerably improved tensile strength over the molds prepared using untreated impure silica sand at the same resin loading.

Resin components useful in the no-bake process are polyols and polyisocyanates. A variety of polyols can be used, but resole-type phenolic resins are often employed. These are usually dissolved in a solvent mixture and mixed with the sand. Polyisocyanates, either as liquids or in solution, are also added. Then a basic catalyst is added to the mixture just before it is placed in the mold. It cures without heating. Tertiary amines are commonly used as the basic catalysts. When the silicate-treated silica sand of this invention is used in the base-catalyzed "no-bake" process, the resulting cores show better tensile strength and better scratch hardness than do cores prepared from untreated impure silica sand. Cores prepared from the treated sand are also easier to remove from the core box.

It is often the practice in the foundry art to include a variety of additives in the resins used to prepare foundry cores and molds. These additives include such materials as silanes, sources of fluoride, deodorizing agents and the like. Such additives may be used with resins in the present process and do not interfere with the improved tensile strength of the cores and molds obtained from the sands of this invention.

The following examples illustrate the invention. It is to be understood that the examples are illustrative only and do not intend to limit the invention in any way. In the examples, all parts and percentages are by weight and the temperatures are degrees centrigrade unless otherwise indicated. All tensile strengths are given in pounds per square inch (psi).

EXAMPLE 1

An aqueous solution containing 2.8 g/l of sodium silicate was prepared by mixing with 10 l of water 73 g of a sodium silicate solution available from the Diamond Shamrock Corp., containing 9.1% by weight of $Na_2O$ and 29.2% by weight of $SiO_2$. Five kilograms of 20KK silica sand was added to the silicate solution and the mixture was stirred for 40 minutes. After stirring was stopped, the sand was allowed to settle for 30 minutes before the liquid was decanted. The sand was then dried at 121° C. overnight. A 1-kg sample of the treated sand was heated to 128° C. and added to a Hobart Mixer. After 30 g of commercial novolak foundry resin was added to the mixer, the mixture of resin and sand was blended for 90 seconds to melt the resin and coat it onto the sand. Then 14.4 ml of a 27.6% solution of hexamethylenetetramine in water was added to the mixer. Blending was continued until the mixture broke up into free-flowing grains of resin-coated sand.

This procedure was repeated using Ludington, Beneficiated Muskegon W/51 and Wedron 7020 silica sands.

Cold tensile and hot tensile strengths of test specimens made from each of the coated sands were measured as follows:

The hot tensile strengths were determined by use of a Dietert No. 365 Hot Shell Tensile Tester. Tests were run at 232° C. with a 3-minute cure time.

The cold tensile strengths were determined by making ¼-inch thick "dog-bone" test briquets in a Dietert No. 363A Heated Shell Curing Accessory. The test briquets were cured for 3 minutes at 232° C. and allowed to cool to room temperature. The cold tensile strength of each briquet was determined by using a 401 Universal Sand Strength Tester in the manner set forth by the American Foundryman's Society.

Results of tests using the various silica sands are given in Table I.

CONTROL TEST 1

The untreated sands used as starting materials in Example 1 were coated with novolak resin according to the procedure of Example 1. The hot and cold tensile strengths of cores made from these resin-coated sands were likewise tested by the procedure of that example. Results of these control tests are given in Table I.

CONTROL TEST 2

Each of the sands used in Example 1 was washed and dried using the same general procedure of Example 1 except that no sodium silicate was added to the washwater. The washed sand was coated with novolak resin following the procedure of Example 1, and hot and cold tensile strengths were determined for cores made from these resin-coated sands. Results of these control tests are given in Table I.

These results show that impure silica lake sands given foundry cores and molds with improved tensile strengths if they are treated with a silicate solution before they are coated with a foundry resin. In contrast, cores and moles made from resin-coated, silicate-treated pure silica sand show no improvement in tensile strength over those prepared from untreated pure silica sand.

TABLE I

| Sand Type | Treatment | Core Properties: Hot Tensile (psi) | Core Properties: Cold Tensile (psi) |
|---|---|---|---|
| 20KK[a] | Untreated (Control Test 1) | 278 | 400 |
| | Water washed (Control Test 2) | 363 | 459 |
| | Silicate treated | 432 | 525 |
| Ludington[b] | Untreated (Control Test 1) | 190 | 230 |

TABLE I-continued

| Sand Type | Treatment | Core Properties: Hot Tensile (psi) | Core Properties: Cold Tensile (psi) |
|---|---|---|---|
| | Water washed (Control Test 2) | 230 | 250 |
| | Silicate treated | 335 | 345 |
| Beneficiated Muskegon W/51[c] | Untreated (Control Test 1) | 297 | 353 |
| | Water washed (Control Test 2) | 284 | 392 |
| | Silicate treated | 377 | 450 |
| Wedron 7020[d] | Untreated (Control Test 1) | 352 | 465 |
| | Water washed (Control Test 2) | 304 | 500 |
| | Silicate treated | 300 | 500 |

[a]A lake sand available from the Martin Marietta Corp., Bridgman, Michigan, containing about 94% $SiO_2$ and smaller amounts of $Al_2O_3$ plus alkaline oxides and alkaline earth oxides.
[b]A lake sand available from the Sargent Sand Co., Saginaw, Michigan, containing 96.2% $SiO_2$ and smaller amounts of $Fe_2O_3$ and $Al_2O_3$ plus alkaline oxides and alkaline earth oxides. The untreated sand contained 7.3 ppm (parts per million) sodium; the silica-treated sand contained 94 ppm sodium.
[c]A washed and dried lake sand available from the Nugent Sand Co., Muskegon, Michigan, containing about 95% $SiO_2$ and smaller amounts of $Al_2O_3$ plus alkaline oxides and alkaline earth oxides.
[d]A pure silica sand available from the Martin Marietta Corp., Wedron, Illinois, containing over 99.8% $SiO_2$.

EXAMPLE 2

An aqueous solution of sodium silicate was prepared by adding 12.6 g of the commercially available sodium silicate solution used in Example 1 to 200 g of water. A mixture of 25.7 g of the silicate solution and 1100 g of 20KK silica sand (0.53 g sodium silicate per kg sand) was mixed in a Hobart Mixer at room temperature for 12 minutes before it was dried overnight at 232° C. One thousand grams of the treated sand was coated with 30 g of phenolic novolak resin at 128° C., and 14.4 ml of a 27.6% hexamethylenetetramine solution was added according to the procedure of Example 1. Hot and cold tensile strengths were determined for cores prepared using the resin-coated sand.

This procedure was repeated using Muskegon 850 and Vassar silica sands.

Results of the tests are reported in Table II.

For control tests, untreated 20KK, Muskegon 850 and Vassar sands were coated with phenolic novolak resin and hexamethylenetetramine solution. Hot and cold tensile strengths were then measured on cores prepared from these coated sands. The results of these control tests are also reported in Table II.

TABLE II

| Sand Type | Treatment | Core Properties: Hot Tensile (psi) | Core Properties: Cold Tensile (psi) |
|---|---|---|---|
| 20KK[a] | Untreated (Control) | 251 | 278 |
| | Silicate treated | 373 | 381 |
| Muskegon 850[b] | Untreated (Control) | 242 | 299 |
| | Silicate treated | 303 | 350 |
| Vassar Sand[c] | Untreated (Control) | 165 | 215 |
| | Silicate treated | 213 | 257 |

[a]A lake sand available from the Martin Marietta Corp., Bridgman, Michigan, containing about 94% $SiO_2$ and smaller amounts of $Al_2O_3$ plus alkaline oxides and alkaline earth oxides.
[b]A bank sand containing about 91% $SiO_2$ and smaller amounts of $Al_2O_3$, $Fe_2O_3$, and alkaline oxides available from the Nugent Sand Co., Muskegon, Michigan.
[c]A bank sand available from Sargent Sand Co., Saginaw, Michigan, containing about 90% $SiO_2$ and smaller amounts of $Al_2O_3$, alkaline oxides and alkaline earth oxides.

This experiment demonstrates that silica sands can be treated with a silicate solution to give improved foundry sands and that it is unnecessary to separate the silicate solution mechanically from the treated sand.

EXAMPLE 3

Sand mixtures were prepared using various proportions of Wedron 7020, a pure silica sand, and 20KK, a lake sand containing about 94% silicon dioxide. The mixtures, which contained from 96.4 to 99.6% silicon dioxide, were treated with sodium silicate solutions by the procedure of Example 2. Both treated and untreated sands were coated with novolak resin according to the procedure of Example 1. Hot and cold tensile strengths were measured on cores prepared from these coated sands. Results of these tests showed that silicate treatment is effective in improving tensile properties of cores made from sands containing less than about 99% silicon dioxide.

EXAMPLE 4

The general procedure of Example 2 was repeated with 20KK silica sand using amounts of sodium silicate varying from 0.11 to 1.79 g of sodium silicate per kg of sand. Hot and cold tensile strengths were obtained for cores prepared from silicate-treated sands which had been coated with novolak resin. These tests showed that the impure silica lake sand gave foundry cores with improved tensile strengths if the sand was first treated with between about 0.2 g and 1.1 g of sodium silicate per kg of sand.

EXAMPLE 5

In this experiment, 45.5 kg of 20KK bank sand was placed in a cement mixer. To the mixing sand was added an aqueous solution of sodium silicate prepared by mixing 63 g of the commercially available sodium silicate solution used in Example 1 with 1000 g water. Mixing was continued at room temperature for 90 seconds before a gas flame was applied to the mixture. Heating was continued until the temperature of the mixture reached 166° C. The hot treated sand was transferred to a Muller Mixer and coated with phenolic novolak resin at 128° C. using the same relative proportions of resin, hexamethylenetetramine and sand as used in Example 2.

In a control experiment, untreated 20KK bank sand was heated to 180° C., transferred to a Muller Mixer and coated with phenolic novolak resin by the same procedure used to coat the treated sand.

Cores were prepared from the treated coated sand as well as from untreated coated sand which was used as a control. Hot and cold tensile strengths of the cores were measured by the standard procedures. SIlicate-treated coated sand gave cores with showed a hot tensile strength of 468 psi and a cold tensile strength of 471 psi. These values compared with a hot tensile strength of 336 psi and a cold tensile strength of 362 psi for cores prepared from the untreated coated sand.

This experiment shows that the procedure of this invention is readily scaled up to a commercially acceptable process without the need for mechanical separation of the silicate solution from the treated sand.

EXAMPLE 6

An aqueous solution of sodium silicate was prepared by diluting 17 g of a sodium silicate solution available from the Diamond Shamrock Corp. containing 6.7% $Na_2O$ and 25.8% $SiO_2$ with 196 g of water. This solution was used to treat Vassar sand according to the procedure of Example 2 and test cores were evaluated as described in that example.

Foundry cores prepared with silicate-treated sand showed a hot tensile strength of 253 psi and a cold tensile strength of 270 psi. These values compared with a hot tensile strength of 165 psi and a cold tensile strength of 215 psi for the control sand which had not been treated with silicate solution.

EXAMPLE 7

A mixture of 1000 g of 20KK silica sand, treated with sodium silicate solution as in Example 2, and 30 g of 701 Liquid Shell Resin (a single-stage shell resin solution available from the Acme Resin Corporation, Forest Park, Ill., having a pH of 3.5 to 4.5, a viscosity at 25° C. of 3500–4500 cps and a solids content of 72% to 75% by weight) was mixed in a Hobart Mixer for 3 minutes at 149° C. Then 14 ml of water was added to cool the coated sand and cause the sand to break up into individually coated grains. After the individual grains had formed, 1.2 g of calcium stearate was added and mixing was continued for 1 minute. Hot and cold tensile strengths of test specimens prepared from the sand were determined by the procedures described in Example 1. The hot tensile strength of the specimens was 140 psi and the cold tensile strength was 410 psi.

Control tests performed using untreated 20KK sand gave specimens showing 100 psi cold tensile and 270 psi hot tensile strengths.

These results show that cores prepared using silicate-treated sand coated with single-stage shell resins have improved hot and cold tensile strength over cores prepared from untreated impure sand.

EXAMPLE 8

This is an example of a "no-bake" foundry process. Silicate-treated 20KK bank sand was prepared as in Example 5. To 2500 g of the silicate-treated sand in a K-45 Kitchen Aid Mixer was added 17.2 g of Acme Bond 5022 polyol, 14.1 g of Acme Bond 5062 polyisocyanate and 0.63 g of Acme Bond 5082 basic catalyst. The Acme Bond components are available from the Acme Resin Corporation, Forest Park, Ill. Sand and resin components were mixed for 1 minute and discharged into a Dietert No. 623-50 pyramid core box. The sand was jolted 4 times using a Dietert No. 623 core box jolter. A thermometer was inserted about 6 inches into the core. The stripping time is the time it takes to cure the core so hard that the thermometer can no longer be pushed by hand deeper into the core. Strip time was determined to be 5 minutes 15 seconds.

A second identical sand-resin mix was prepared and discharged into a Dietert No. 696, 12-gang tensile core box to prepare 12 standard American Foundrymen's Society 1-inch dog bone tensile briquets. The cores were cured at room temperature and broken after 1 hour and 24 hours. Humidity testing was carried out by placing tensile briquets in 80% and 90% relative humidity (r.h.) chambers for 24 hours before determining tensile strengths. The tensile strengths were measured using a Detroit Testing Machine Co. Model SCT Tester, and scratch hardness was determined using a Dietert No. 674 scratch hardness tester. Results of the tests are summarized in Table III.

As a control, the above procedure was repeated using untreated 20KK lake sand with the same amount of resin components except that 0.75 g of the Acme Bond 5082 catalyst was used. In this case, a strip time of 5 minutes 30 seconds was obtained. Results of the other control tests are given in Table III.

TABLE III

| Cores Prepared From | Tensile, psi and (Scratch Hardness) 1 hr | 24 hrs | 24 hrs @ 80% r.h | 24 hrs @ 90% r.h. |
|---|---|---|---|---|
| Treated Sand | 147 (64) | 267 (72) | 217 (71) | 157 (61) |
| Utreated Sand (Control) | 120 (62) | 183 (70) | 200 (70) | 123 (64) |

These results show that cores prepared from the silicate-treated sand by a base-catalyzed "no-bake" process generally give improved tensile strength and better scratch hardness than the cores prepared from untreated impure sand. Cores prepared from treated sand also gave improved release from the core box. This property is beneficial because sticking to the core box slows production in a foundry and can result in core or mold damage during removal from the pattern.

EXAMPLE 9

A mixture of 4000 g of 20KK silica sand, treated with sodium silicate solution as in Example 2, and 40 g of powdered corn cereal was mulled in a Simpson Mix-Muller (18-inch model) for 1 minute. Then 80 g of water was added and mulling was continued for an additional 4 minutes. Mulling was stopped and 20 g of foundry core oil, obtained from the Archer-Daniels-Midland Company, Minneapolis, Minn., was added. The mixture was mulled for 1 minute and collected in a polyethylene bag. The bag was sealed immediately to minimize contact with the air.

Green compression strength of the coated sand was determined by placing 168 g of the material in a Dietert Detroit No. 315-9 specimen tube. The specimen was rammed three times with a Dietert Detroit No. 315 sand rammer. The resulting 2-inch×2-inch test cylinder was compressed in a Dietert Detroit No. 465 compression instrument to determine the green compression strength.

Baked tensile strength specimens were prepared from the coated sand by placing the sand in a tensile specimen mold and ramming it four times with the Dietert Detroit No. 315 sand rammer. Specimens were placed in a tray in a circulating air oven at 224° C. Specimens were removed from the oven at varying times. After the specimens had cooled to room temperature, their tensile strengths were measured using a Detroit Testing Machine, Model CST, tensile tester. Each value reported is the average of the strengths measured using three specimens.

For comparative tests, specimens were prepared from coated 20KK sand that had not been treated with silicate solutions.

The results given in Table IV show that cores made from silicate-treated sand coated with a core oil mix exhibit about 25% greater tensile strength than do cores made from uncoated sand when the cores are baked for 30 minutes.

TABLE IV

| | Tests on Specimens From Silicate-Treated Sand (psi) | Control Tests (psi) |
|---|---|---|
| Green Compression | 0.5 | 0.45 |
| Baked Tensile Strength | | |
| Baking Time, min) | | |

TABLE IV-continued

| | Tests on Specimens From Silicate-Treated Sand (psi) | Control Tests (psi) |
|---|---|---|
| 15 | 60 | 60 |
| 30 | 225 | 180 |
| 45 | 215 | 180 |
| 60 | 235 | 187 |

Thus, it is apparent that there has been provided, in accordance with the invention, a process for the preparation of resin-coated silica sands that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to include all such alternatives, modifications, and variations as set forth within the spirit and scope of the appended claims.

What is claimed is:

1. A process for the preparation of treated silica sand useful for the preparation of foundry cores and molds having improved tensile strength which comprises treating impure silica sand containing from about 85% to less than about 99% of weight of silicon dioxide with a solution consisting of an alkali metal silicate and water and heating the mixture of sand and silicate to give a treated silica sand containing from about 0.2 g to about 1.1 g of silicate per kg of sand on a dry solids basis.

2. The process of claim 1 wherein the alkali metal silicate is sodium silicate.

3. The process of claim 1 wherein the impure silica sand is selected from the group consisting of 20KK lake sand, Ludington lake sand, Muskegon bank and lake sands, and Vassar bank sand.

4. The process of claim 1 wherein the silica sand is separated from the aqueous solution of an alkali metal silicate before the mixture of sand and silicate is heated.

5. A process for the preparation of a molding composition useful for forming foundry cores and molds having improved tensile strength which comprises treating impure silica sand containing from about 85% to less than about 99% by weight of silicon dioxide with a solution consisting of an alkali metal silicate and water heating the mixture of sand and silicate to give a treated silica sand containing from about 0.2 g to about 1.1 g of silicate per kg of sand on a dry solids basis, and mixing or coating the treated sand with an effective bonding amount of a binder selected from the group consisting of shell resins, base-curing "no-bake" resin components and core oil mixes.

6. The process of claim 5 wherein the alkali metal silicate is sodium silicate.

7. The process of claim 5 wherein the impure silica sand is selected from the group consisting of 20KK lake sand, Ludington lake sand, Muskegon bank and lake sands, and Vassar bank sand.

8. The process of claim 5 wherein the silica sand is separated from the aqueous solution of an alkali metal silicate before the mixture of sand and silicate is heated.

9. The process of claim 5 wherein the binder is a shell resin which further comprises the curing agent hexamethylenetetramine.

10. The process of claim 5 wherein the binder consists of "no-bake" resin components which comprise a polyol and a polyisocyanate.

11. The process of claim 10 wherein the resin components further comprise a tertiary amine.

12. The process of claim 5 wherein the binder is a core oil mix comprising a drying oil and a cereal binder.

13. A silica foundry sand useful for the preparation of foundry cores and molds having improved tensile strength prepared by treating impure silica sand containing from about 85% to less than about 99% by weight of silicon dioxide with a solution consisting of an alkali metal silicate and water and heating the mixture of sand and silicate to give a product containing from about 0.2 g to about 1.1 g of silicate per kg of sand on a dry solids basis.

14. The product of claim 13 wherein the alkali metal silicate is sodium silicate.

15. The product of claim 13 wherein the impure silica sand is selected from the group consisting of 20KK lake sand, Ludington lake sand, Muskegon bank and lake sands, and Vassar bank sand.

16. The product of claim 13 wherein the silica sand is separated from the aqueous solution of an alkali metal silicate before the mixture of sand and silicate is heated.

17. A molding composition useful for the preparation of foundry cores and molds having improved tensile strength comprising an impure silica sand containing from about 85% to less than about 99% by weight of silicon dioxide, previously treated by heating with a solution consisting of an alkali metal silicate and water to give a treated sand containing from about 0.2 g to about 1.1 g of silicate per kg of sand on a dry solids basis, and an effective bonding amount of a binder selected from the group consisting of shell resins, base-curing "no-bake" resin components and core oil mixes.

18. The composition of claim 17 wherein the alkali metal silicate is sodium silicate.

19. The composition of claim 17 wherein the impure silica sand is selected from the group consisting of 20KK lake sand, Ludington lake sand, Muskegon bank and lake sands, and Vassar bank sand.

20. The composition of claim 17 wherein the binder is a shell resin which further comprises the curing agent hexamethylenetetramine.

21. The composition of claim 17 wherein the binder consists of base-curing "no-bake" resin components which comprise a polyol and a polyisocyanate.

22. The composition of claim 21 wherein the resin components further comprise a tertiary amine.

23. The composition of claim 17 wherein the binder is a core oil mix comprising a drying oil and a cereal binder.

* * * * *

UNITED STATES PATENT AND TRADEMARK OFFICE

CERTIFICATE OF CORRECTION

PATENT NO. : 4,469,517

DATED : September 4, 1984

INVENTOR(S) : Richard C. Cooke, Jr.

It is certified that error appears in the above-identified patent and that said Letters Patent are hereby corrected as shown below:

Column 1, line 12, "foundary" should read --foundry--.
Column 2, line 4, "or" should read --of--.
Column 2, line 20, "foundary" should read --foundry--.
Column 3, line 49, "and" should read --sand--.
Column 4, line 59, "centrigrade" should read --centigrade--.
Column 5, line 50, "given" should read --give--.
Column 5, line 54, "moles" should read --molds--.
Column 6, line 64, after "$Al_2O_3$, insert --$Fe_2O_3$,--.

Signed and Sealed this

*Eighteenth* Day of *June 1985*

[SEAL]

*Attest:*

DONALD J. QUIGG

*Attesting Officer* *Acting Commissioner of Patents and Trademarks*